US007970295B2

(12) United States Patent
Willis

(10) Patent No.: US 7,970,295 B2
(45) Date of Patent: Jun. 28, 2011

(54) DOCUMENT PROCESSING SYSTEM AND METHOD FOR ADJUSTABLE PRINT CONSUMABLE REFILL LEVEL

(75) Inventor: Keith L. Willis, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 672 days.

(21) Appl. No.: 12/020,733

(22) Filed: Jan. 28, 2008

(65) Prior Publication Data

US 2009/0190937 A1 Jul. 30, 2009

(51) Int. Cl.
*G03G 15/00* (2006.01)
*G03G 15/08* (2006.01)

(52) U.S. Cl. ..... 399/27; 399/81; 399/9

(58) Field of Classification Search ..... 399/9, 23–30, 399/79–81

See application file for complete search history.

(56) References Cited

U.S. PATENT DOCUMENTS

| | | | | |
|---|---|---|---|---|
| 6,229,975 | B1 * | 5/2001 | Wilhelm et al. | 399/258 |
| 6,748,186 | B1 | 6/2004 | Skrainar et al. | |
| 7,009,719 | B2 | 3/2006 | Willis et al. | |
| 7,280,781 | B2 | 10/2007 | Willis | |
| 2003/0077086 | A1 * | 4/2003 | Phillips | 399/24 |
| 2004/0012645 | A1 * | 1/2004 | Kinalski et al. | 347/7 |
| 2005/0074246 | A1 * | 4/2005 | Hayward et al. | 399/8 |

* cited by examiner

*Primary Examiner* — David P Porta
*Assistant Examiner* — Jessica L Eley
(74) *Attorney, Agent, or Firm* — Fay Sharpe LLP

(57) ABSTRACT

Document processing systems and methods are presented in which a graphical user interface is used to set a user-selectable refill level for a print engine consumable, such as toner, replenisher, paper, etc. Once the user-selectable level has been reached, the user is notified and is prompted to either refill the print consumable or to continue use of the document processing system without refilling.

19 Claims, 6 Drawing Sheets

DOCUMENT PROCESSING SYSTEM AND METHOD FOR ADJUSTABLE PRINT CONSUMABLE REFILL LEVEL

BACKGROUND

The present exemplary embodiment relates to document processing systems such as printers, copiers, multi-function devices, etc., and more particularly to automatic user notification of print consumables reaching user-selectable levels in document processing systems that are supplied with consumable materials such as toner, ink, replenisher, paper, etc. Print systems often provide only end-of-supply signals to the user after the consumable has been depleted, such as "out-of-toner" indications after the system has been stopped. Thus, replacement of toner cartridges, paper, and other print system consumable supplies generally contributes to system down-time. Users wishing to proactively check consumable levels before the "out-of" condition generally must open outer access doors to view the contents of toner bottles, paper trays, etc. However, frequent opening of access doors could potentially cause or aggravate nuisance, ozone, heat, and dust (NOHAD) problems for the system, particularly for print systems that provide temperature controlled environments for print engines. Some systems may also provide "Machine Status" screens allowing a user to ascertain the present consumable levels, but such screens are typically difficult to find, forcing the user to navigate through different menus on the printer controls. Consequently, most printing system users prefer to instead wait until they receive an "Add Toner" or "Low Toner" message rather than navigating through screens to get status information. Thus, there remains a need for improved techniques and systems to facilitate the timely proactive provision of replenishable consumables to document processing systems while mitigating system down-time and user frustration.

BRIEF DESCRIPTION

The present disclosure provides document processing systems and methods by which toner and other print system consumable materials can be replenished in a timely fashion without excessive system down time, in which the user is able to set consumable refill levels at which a user interface informs the user. The indicated consumable can then be refilled or "topped-off", either on-line or off-line, or the user can elect to continue operation with the conventional default notification (e.g., "Toner Low") occurring thereafter if the consumable material becomes depleted. In this manner, the disclosure facilitates proactive consumable replenishment in any form of document processing system by allowing a user to define their own "top-off" levels for adding toner, ink, replenisher, paper, etc. prior to the supply running out while mitigating system down-time. Moreover, the disclosure can be advantageously employed to mitigate NOHAD issues by providing supply level information without forcing the user to open access doors of the system for visual level checking. The disclosed techniques and systems track the consumable supply levels and provide user interface feedback when the user-selectable top-off levels have been reached, whereupon the user can choose to refill the consumable supply or to override the notification to continue printing system operation.

In accordance with one or more aspects of the disclosure, a document processing system is provided, which comprises a print engine operative to print images on a printable media and a print consumable supply system which operates to supply print consumable from one or more print consumable dispensers to the print engine. The print consumable may be toner, replenisher, ink, paper, or other refillable consumable material that is employed by a document processing system. The document processing system also includes a controller coupled with the print engine and the print consumable supply system that determines an amount of remaining print consumable, as well as a user interface operatively coupled with the controller to provide a notification when the amount of remaining print consumable reaches a user-selectable refill level.

The user interface in certain embodiments includes a graphic display, and the interface may be separate from or integral with the document processing system. The user interface, moreover, may be operative to prompt the user to set the user-selectable refill level. When the refill level has been reached in the exemplary embodiments, the user interface renders a display screen indicating that the refill level has been reached and prompts the user to either refill the print consumable or to continue use of the document processing system without refilling. If the user continues system usage without refilling, the interface provides a subsequent notification when the amount of remaining print consumable reaches a fixed value, such as the normal "toner low" or "out-of-toner" level.

In certain embodiments where the print engine uses print consumable of a first color supplied via two or more dispensers, the controller determines the amount of remaining print consumable in the first and second dispensers and the user interface allows the user to set a refill level for the consumable associated with the first color in terms of the number of empty dispensers associated with that color, and to provide a notification when the refill level associated with the first color has been reached. For multi-color systems, moreover, the user interface allows the user to set individual refill levels for the print consumable of each color and to provide a notification when any of these refill levels has been reached.

Further aspects of the disclosure provide a method for notifying a user of the amount of remaining print consumable in a document processing system. The method includes automatically determining the amount of remaining print consumable, comparing that amount to a user-selectable refill level, and selectively providing a notification to a user when the amount of remaining print consumable reaches the user-selectable refill level using a user interface operatively associated with the document processing system, where the notification in certain embodiments is provided using a graphic display of a user interface. The method may further include prompting the user to set the user-selectable refill level via the user interface, and when the user-selectable refill level has been reached, prompting the user to either refill the print consumable or to continue use of the document processing system without refilling. The method, moreover, may further include providing a subsequent notification when the consumable reaches a fixed value below the user-selectable refill level if the user continues use of the document processing system without refilling. In addition, the method may include allowing the user to refill the print consumable while the document processing system continues to operate.

BRIEF DESCRIPTION OF THE DRAWINGS

The present subject matter may take form in various components and arrangements of components, and in various steps and arrangements of steps. The drawings are only for purposes of illustrating preferred embodiments and are not to be construed as limiting the subject matter.

DETAILED DESCRIPTION

Figure 1:
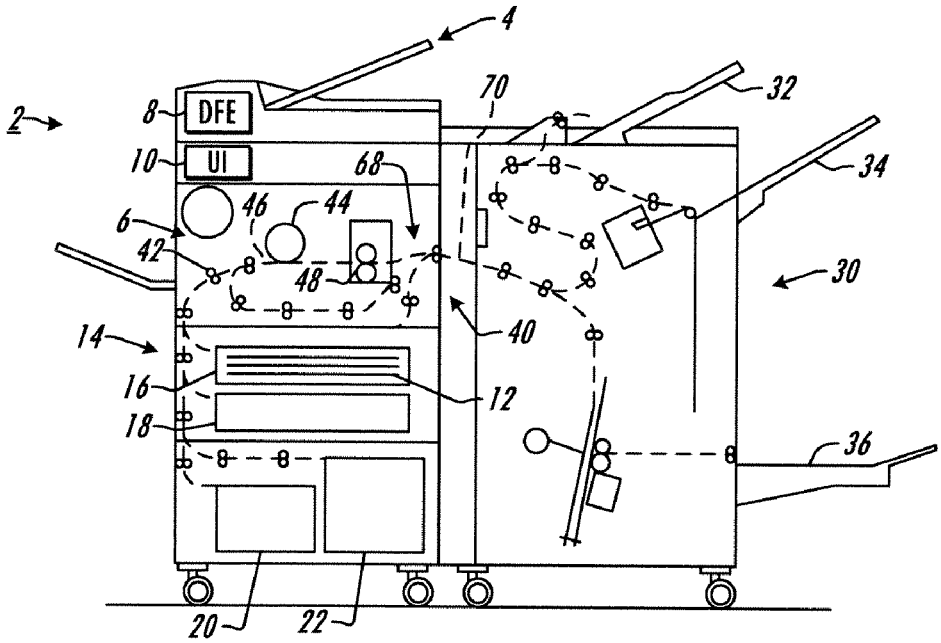
FIG. 1 is a schematic system level diagram illustrating an exemplary document processing system with a print engine and a user interface that provides user-selectable print consumable level notifications according to one or more aspects of the present disclosure.

Referring now to the drawings, several embodiments or implementations of the present disclosure are hereinafter illustrated and described, wherein like reference numerals are used to refer to like elements throughout, and wherein the various features, structures, and user interface renderings are not necessarily drawn to scale. The disclosure relates to automatic notifications of printing system supply levels that may be advantageously implemented to facilitate timely print consumable replenishment while mitigating system down-time, user frustration, and NOHAD problems in document processing systems. In particular, the illustrated embodiments do not force system operators or users to wait until a consumable material color has reached empty to refill it, or to repeatedly open the printer or navigate through various machine status screens in order to check the supply levels, but instead lets the user set their own top-off levels and alerts the user when one or more of these levels has been reached. Once the interface provides this notification, the user can either respond to it by adding toner, ink, paper, replenisher, or other print consumable, or can ignore it by selecting a "Continue" button to continue printing without refilling.

The various aspects of the disclosure are illustrated and described below in the context of exemplary graphical user interface display screens which can be rendered to a user or operator at a user interface integral with a document processing (printing) system, and/or which can be provided as a display on a user's personal computer or other device operatively connected to the document processing system, such as by one or more wired and/or wireless networks, wherein any such implementations and variations thereof are contemplated as falling within the scope of the present disclosure. Moreover, while the various aspects of the disclosure are described in the context of providing user-friendly graphical indications of toner levels reaching user-selectable levels in multi-color printing systems, the various concepts and aspects of the disclosure are also applicable to other forms of printing system consumables, including without limitation toner, replenisher, ink, paper, etc., wherein the disclosure is not limited to the illustrated embodiments.

Figure 2:
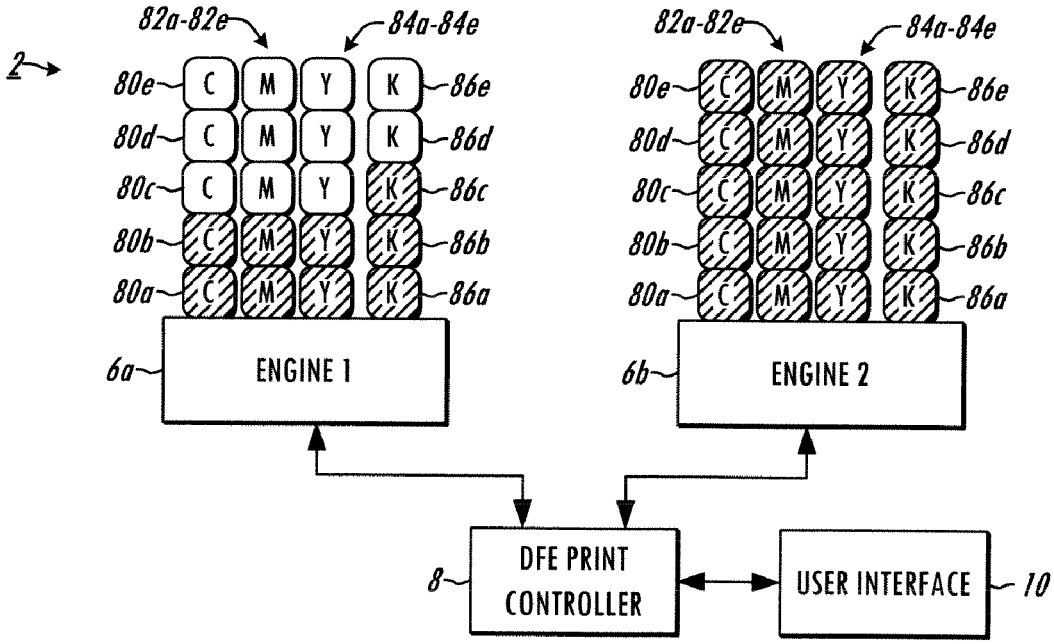
FIG. 2 is a simplified schematic diagram illustrating an exemplary dual-print engine implementation of the system of FIG. 1 with two similarly equipped print engines having dedicated toner consumable supply systems, each supply system including multiple dispensers for each color, and with a controller that provides toner levels to a graphical user interface in accordance with the present disclosure.
Figure 3:
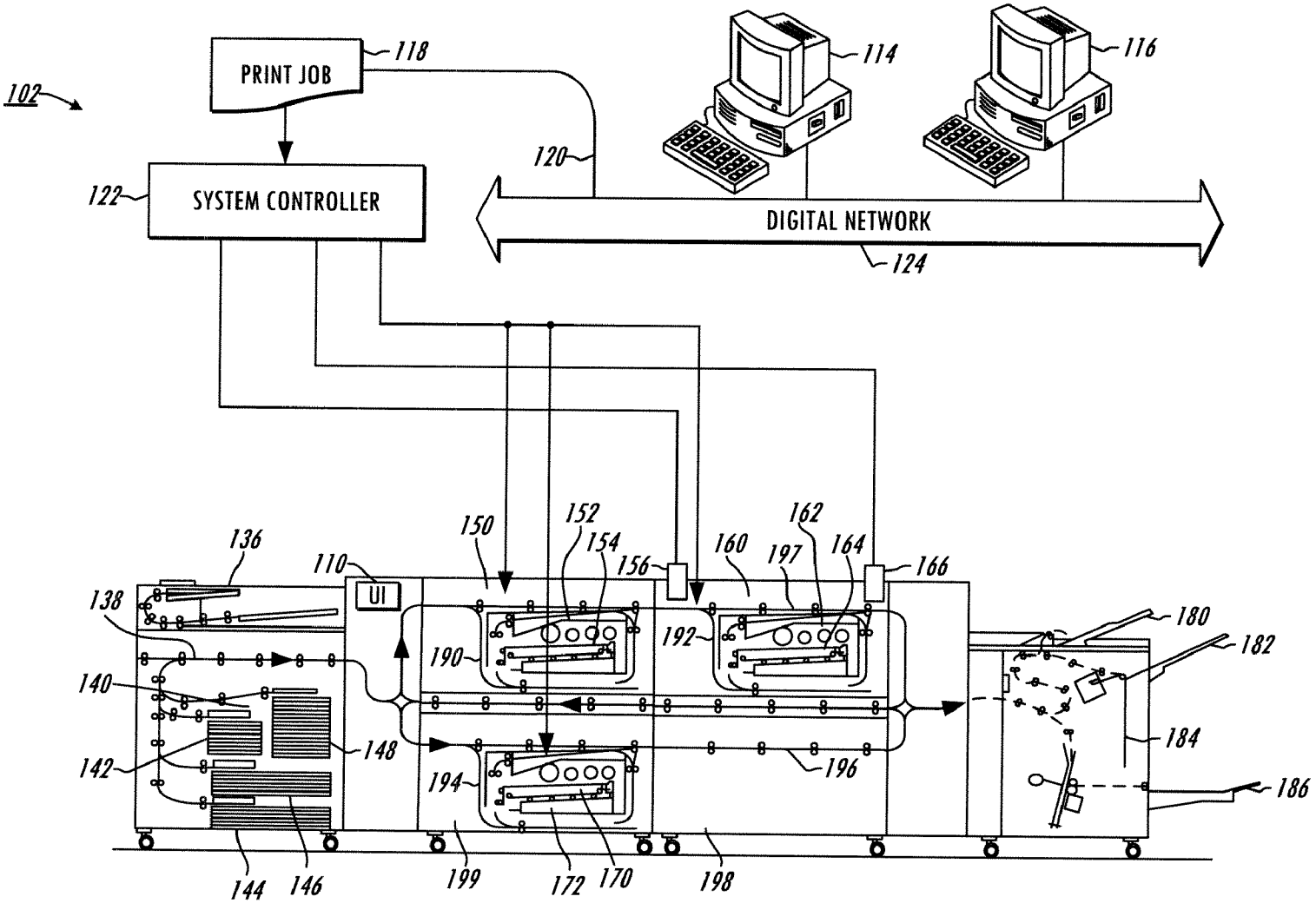
FIG. 3 is a schematic system level diagram illustrating another exemplary document processing system with multiple print engines in which the user-selectable consumable level notification aspects of the present disclosure may be carried out.

FIGS. 1 and 2 illustrate one exemplary document processing or printing system 2 and a user interface 10 thereof in which one or more exemplary aspects of the disclosure may be implemented. FIG. 3 illustrates another exemplary document processing system 102 having multiple print engines in which the various aspects of the present disclosure may also be advantageously implemented. The system 2 of FIG. 1 can be any form of commercial printing apparatus, copier, printer, facsimile machine, or other system which may include a scanner or other input device 4 that scans an original document text and/or images to create an image comprising pixel values indicative of the colors and/or brightness of areas of the scanned original, or receives images such as in a print job, and which has a marking engine or print engine 6 by which visual images, graphics, text, etc. are printed on a page or other printable medium, including xerographic, electro photographic, and other types of printing technology, wherein such components are not specifically illustrated in FIG. 1 to avoid obscuring the various consumable level notification aspects of the present disclosure.

As shown in FIG. 1, the exemplary document processing system 2 includes a print engine 6, which may be any device or marking apparatus for applying an image from a digital front end (DFE) printer job controller 8 to printable media (print media) such as a physical sheet of paper, plastic, or other suitable physical media substrate for images, whether precut or web fed, where the input device 4, print engine 6, and controller 8 are interconnected by wired and/or wireless links for transfer of electronic data therebetween, including but not limited to telephone lines, computer cables, ISDN lines, etc. The printing system 2, moreover, includes an integral user interface 10 with a display and suitable operator/user controls such as buttons, touch screen, etc. The print engine 6 generally includes hardware and software elements employed in the creation of desired images by electrophotographic processes wherein suitable print engines 6 may also include ink-jet printers, such as solid ink printers, thermal head printers that are used in conjunction with heat sensitive paper, and other devices capable of printing or marking an image on a printable media.

The image input device 4 may include or be operatively coupled with conversion components for converting the image-bearing documents to image signals or pixels or such function may be assumed by the printing engine 6. In the illustrated document processor 2, the printer controller 8 provides the output pixel data from memory to a print engine 6 that is fed with a print media sheets 12 from a feeding source 14 such as a paper feeder which can have one or more print media sources or paper trays 16, 18, 20, 22, each storing sheets of the same or different types of print media 12 on which the marking engine 6 can print. The exemplary print engine 6 includes an imaging component 44 and an associated fuser 48, which may be of any suitable form or type, and may include further components which are omitted from the figure so as not to obscure the various aspects of the present disclosure. In one example, the print engine 6 may include a photoconductive insulating member or photoreceptor which is charged to a uniform potential via a corotron and exposed to a light image of an original document to be reproduced via an imaging laser under control of a controller of the DFE 8, where the exposure discharges the photoconductive insulating surface of the photoreceptor in exposed or background areas and creates an electrostatic latent image on the photoreceptor corresponding to image areas of the original document. The electrostatic latent image on the photoreceptor is made visible by developing the image with an imaging material such as a developing powder comprising toner particles via a development unit, and the customer image is then transferred to the print media 12 and permanently affixed thereto in the fusing process.

In a multicolor electrophotographic process, successive latent images corresponding to different colors can be formed on the photoreceptor and developed with a respective toner of a complementary color, with each color toner image being successively transferred to the paper sheet 12 in superimposed registration with the prior toner image to create a multi-layered toner image on the printed media 12, and where the superimposed images may be fused contemporaneously, in a single fusing process. The fuser 48 receives the imaged print media from the image-forming component and fixes the toner image transferred to the surface of the print media 12, where the fuser 48 can be of any suitable type, and may include fusers which apply heat or both heat and pressure to an image. Printed media from the printing engine 6 is delivered to a finisher 30 including one or more finishing output destinations 32, 34, 36 such as trays, stackers, pans, etc.

The document processing system 2 is operative to perform these scanning and printing tasks in the execution of print jobs, which can include printing selected text, line graphics, images, machine ink character recognition (MICR) notation, etc., on either or both of the front and back sides or pages of one or more media sheets 12. An original document or image or print job or jobs can be supplied to the printing system 2 in various ways. In one example, the built-in optical scanner 4 may be used to scan an original document such as book pages, a stack of printed pages, or so forth, to create a digital image of the scanned document that is reproduced by printing operations performed by the printing system 2 via the print engine 6. Alternatively, the print jobs can be electronically delivered to the system controller 8 via a network or other means, for instance, whereby a network user can print a document from word processing software running on a network computer as illustrated and described in further detail with respect to FIG. 3 below, thereby generating an input print job.

A print media transporting system or network or highway 40 of the document processing system 2 links the print media source 14, the print engine 6, and the finisher 30 via a network of flexible automatically feeding and collecting drive members, such as pairs of rollers 42, spherical nips, air jets, or the like, along with various motors for the drive members, belts, guide rods, frames, etc. (not shown), which, in combination with the drive members, serve to convey the print media 12 along selected pathways at selected speeds. Print media 12 is thus delivered from the source 14 to the print engine 6 via a pathway 46 common to the input trays 16, 18, 20, 22, and is printed by the imaging component 44 and fused by the fuser 48, with a pathway 46 from the print engine 6 merging into a pathway 70 which conveys the printed media 12 to the finisher 30, where the pathways 46, 48, 70 of the network 40 may include inverters, reverters, interposers, bypass pathways, and the like as known in the art. In addition, the print engine 6 may be configured for duplex or simplex printing and a single sheet of paper 12 may be marked by two or more print engines 6 or may be marked a plurality of times by the same marking engine 6, for instance, using internal duplex pathways.

Referring also to FIG. 2, the exemplary document processing system 2 provides an advanced print consumable dispensing apparatus assembly or supply system in which each color toner is provided via a plurality of toner bottles or dispensers, including Cyan (C), Magenta (M), Yellow (Y), and Black (K). As shown in FIG. 2, for example, the Cyan color is supplied via five Cyan toner dispensers 80*a*-80*e*, with each dispenser being adjacent to the previous dispenser 80. Similarly, five bottle dispensers 82*a*-82*e* are provided for Magenta toner, bottles 84*a*-84*e* supply Yellow toner, and bottles 86*a*-86*e* supply black toner to the print engine 6. Moreover, as depicted in FIG. 2, the document processing system 2 may include multiple print engines with associated multi-bottle toner supply systems, wherein the simplified illustration in FIG. 2 depicts a first such print engine 6*a* and a second engine 6*b*, each operatively coupled with the DFE controller 8. In this regard, the system 2 provides multiple dispensers 80, 82, 84, and 86 for each of four toner colors Cyan, Magenta, Yellow, and Black, respectively, for each of the print engines 6*a* and 6*b*. As further illustrated in FIG. 2, the print controller 8 is operatively coupled with the print engines 6*a*, 6*b*, the user interface 10, and the multi-bottle toner supply systems providing toner to the print engines 6*a*, 6*b* so as to provide user configurable notifications of the remaining toner supply for each of the print engines 6*a*, 6*b* in accordance with various aspects of the present disclosure.

Figure 5:
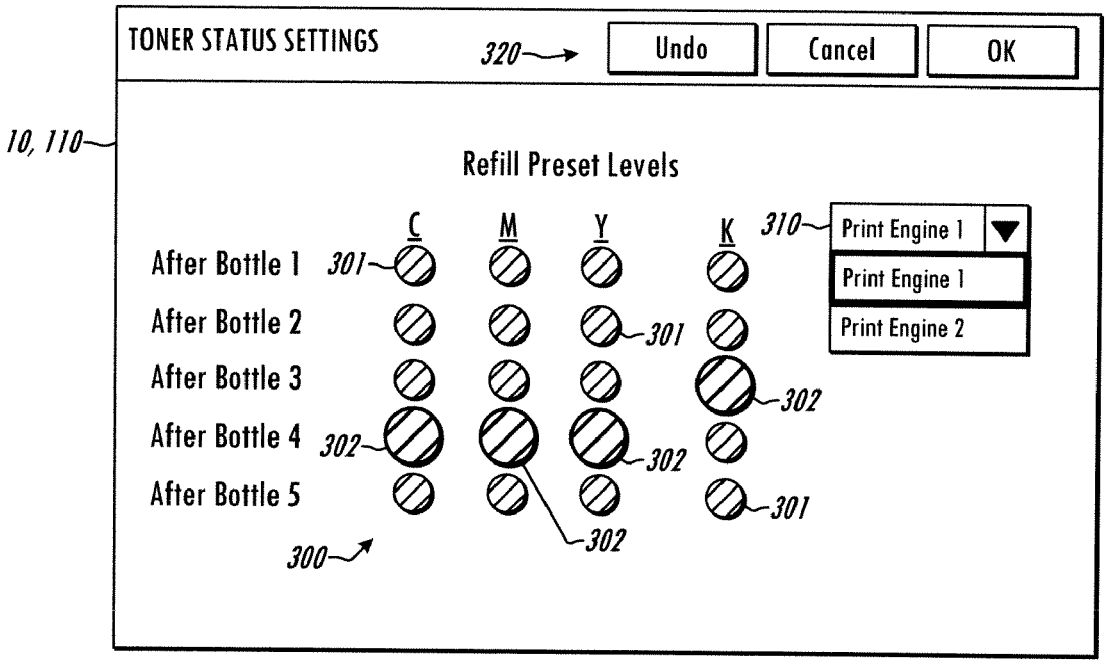
FIG. 5 is a partial view of the exemplary graphical user interface in the systems of FIGS. 1-3 showing prompting for a user to set consumable toner refill levels for a dual print engine multi-color printing system for automatic user notification.
Figure 6:
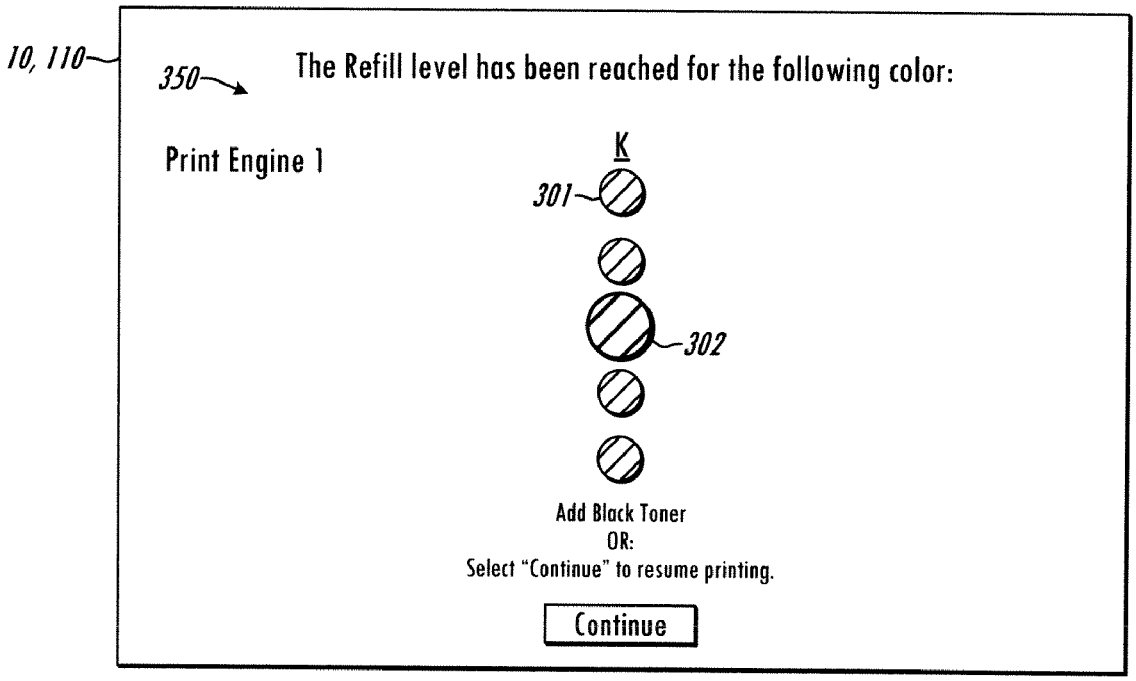
FIG. 6 is a partial view of the user interface in the systems of FIGS. 1-3 showing notification of black toner reaching the user-selected refill level, with the interface prompting the user to refill the toner supply system or continue system use without refilling.
Figure 7:
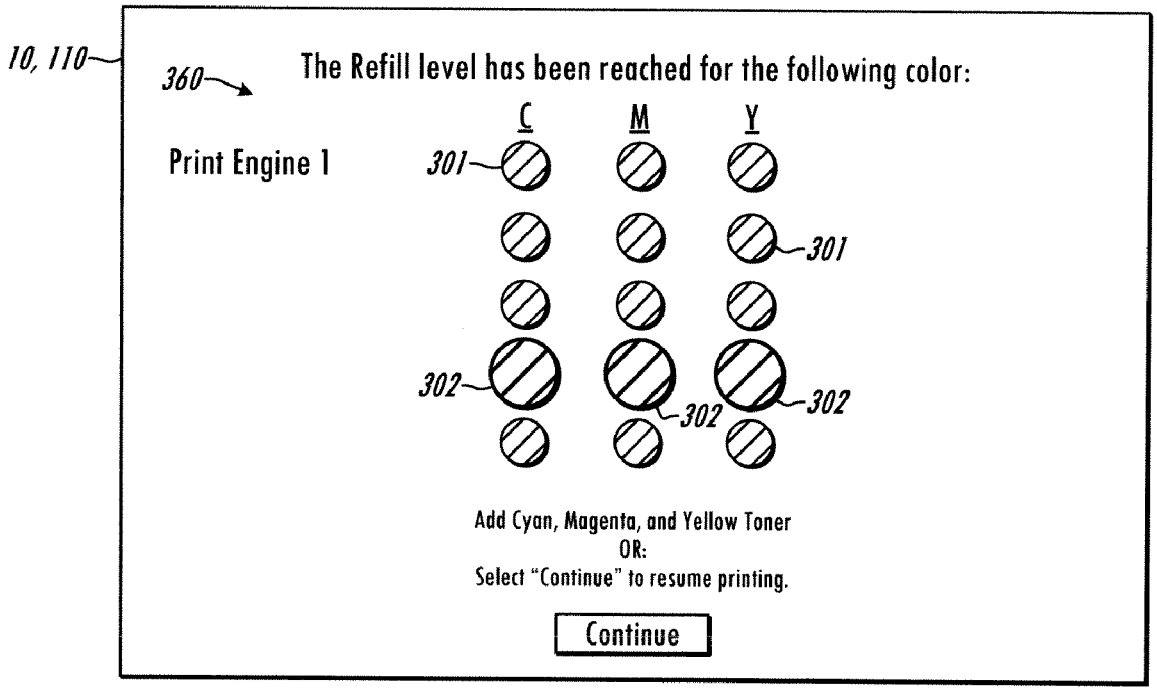
FIG. 7 is a partial view of the user interface in the systems of FIGS. 1-3 showing notification of three toner colors concurrently reaching the user-selected refill levels, along with user prompting to refill the toner supply system or to continue without refilling.

In the exemplary toner supply systems of FIG. 2, the toner dispenser bottles are stacked so that the toner/replenisher will empty throughout the top bottle into the bottom bottle through the flow of gravity or some other mechanical means, with successive dispensers providing consumable to the next lower dispenser. The print consumable inside each bottle 80, 82, 84, 86 can be toner, replenisher, etc., depending on the print engine needs and/or requirements. The user interface 10 is operatively coupled with the first print engine 6*a*, the second print engine 6*b*, and the DFE controller 8 that provides job print scheduling and other functionality. The controller 8 gathers information from one or more sensing mechanisms associated with each of the toner consumable supply systems. In one possible implementation, a sensing mechanism is provided for each set of print consumable dispenser bottles, wherein the sensing mechanism preferably operates to discern the level of toner within partially empty dispensers, in order to provide an indication on the user interface 10 as to which bottles are full, which are empty, and which are partially full. In this regard, any suitable consumable level sensing technology may be employed within the scope of the present disclosure, including without limitation sensing based on opacity, infrared, weight measurement, pressure measurement, or any other known means. The controller 8 receives the signals from the toner level sensors and determines on a regular basis an amount of remaining print consumable for each color C, M, Y, and K. The interface 10 operates under control of the controller 8 according to the determined amounts of remaining toner consumable to render the notifications of when a particular consumable reaches the user-selectable refill levels and to allow the user to set these refill levels. In particular, the interface 10 includes a graphic display and operates to display various screens such as are shown in FIGS. 5-7 below for such notifications and promptings for each of multiple colors (e.g., C, M, Y, and K in the illustrated examples), for either or both of the print engines 6*a* or 6*b*.

The exemplary interface 10 and the consumable level notifications provided by this disclosure are particularly advantageous in systems 2, 102 that employ multiple bottle toner/replenisher/ink supply systems or multiple tray paper supply systems in order to reduce or minimize the system down-time while allowing the user or operator to refill the dispensers (bottles/trays) or otherwise replenish the consumable supply in the system. For instance, a user may advantageously implement a top-off strategy for each toner color that is not at its maximum. As depicted in FIG. 2, for example, the Cyan supply currently has two remaining full toner bottles 80*a* and 80*b*, with the upper three bottles 80*c*-80*e* being currently empty for the first print engine 6*a*. In this example, the same is true of the Magenta and Yellow toner in the first engine 6*a*, with the Black toner supply having three remaining full toner dispensers 86*a*-86*c* in the first engine 6*a* and with the toner dispensers 80-86 of the second engine 6*b* all being full. The user may advantageously employ the interface 10 to establish desired refill levels for each color and for each print engine 6 as shown and described below with respect to FIG. 5 in order to facilitate implementation of a replenishment regimen for the system 2. As described in the illustrated embodiments, the user may set these refill levels so as to receive a refill notification after one more bottle dispenser is emptied for any of the colors in the first print engine 6*a* following the point in time illustrated in FIG. 2.

Referring also to FIG. 3, an exemplary multi-color, multiple print engine document processing system 102 is shown with a graphical user interface 110 providing the user-selectable print consumable refill notifications in accordance with the present disclosure. The system 102 in FIG. 3 includes a plurality of printing or marking systems 150, 160, and 199, each of which having an associated marking or print engine 152, 162, 172 along with corresponding entry and exit inverter/bypasses 190, 192, and 194, respectively. The print engines 152, 162, 172, moreover, may be removable, for example, wherein the system in FIG. 3 illustrates a currently empty marking unit area 198 capable of being outfitted with a fourth print engine (not shown), and wherein one or more of the illustrated print engines 152, 162, 172 may optionally be removed from the system 110 (e.g., for repair, etc.), whereby the system 110 provides a modular approach to multiple-engine system architecture. The provision of multiple print engines enhances the system 110 with respect to features and capabilities as various marking tasks for a given print job 118 may advantageously be distributed among the print engines 152, 162, 172. In this regard, some or all of the print engines 152, 162, 172 may be identical or functionally equivalent in order to provide redundancy or improved productivity through parallel printing. Alternatively or in combination, some or all of the print engines may be different in order to provide different capabilities, for example, where the marking engines 162, 172 may be color marking engines, while the marking engine 152 may be a black (K) marking engine.

As further shown in FIG. 3, the system 102 includes a system controller 122 with digital front end (DFE) functionality as in the example of FIG. 1 above, and is operatively coupled with the user interface 110 and the toner supply systems of each print engine 152, 162, 172 for graphically rendering a toner supply refill notification screen on the interface 110 in accordance with the various aspects of the present disclosure. The controller 122, moreover, may implement image quality control functions to modify one or more target colors via actuators 154, 164, and 170. The illustrated print engines 152, 162, 172 employ xerographic printing technology wherein an electrostatic image is formed and coated with a toner material, and then transferred and fused to paper or another print medium by application of heat and pressure. Alternatively, print engines employing other printing technologies can be provided in the system 102, such as ink jet printing, thermal impact printing, etc.

The system 102 further includes a consumable print media feeding source or feeder 140 with associated media conveying components 138, as well as a finisher 184 implementing various finishing functions such as collation, stapling, folding, stacking, hole-punching, binding, postage stamping, etc. The source 140 includes refillable input trays 142, 144, 146, 148 connected with the print media conveying components 138 to provide selected types of consumable print media to the print engine(s) 152, 162, and/or 172. Each of the print media sources 142, 144, 146, and/or 148 can store sheets of the same type of print media, or can store different types of print media. For example, the print media sources 144, 146 may store the same type of large-size paper sheets, print media source 142 may store company letterhead paper, and the print media source 148 may store letter-size paper. The print media can be substantially any type of media upon which one or more of the marking engines 152, 162, 172 can print, such as high quality bond paper, lower quality "copy" paper, overhead transparency sheets, high gloss paper, etc. The finisher 184 includes two or more print media finishing destinations or stackers 180, 182, 186 for collecting sequential pages of each print job that is being contemporaneously printed by the printing system 60 to accommodate multiple jobs arriving at the finisher 184 concurrently. Once processed, the finisher 184 deposits each sheet in one of the print media finishing destinations 180, 182, 186, which may be trays, pans, stackers and so forth. In addition, bypass routes in each print engine 152, 162, and 172 allow certain sheets to pass through the processing unit without interacting with the print engine. Also, branch paths are provided to take the sheet into the associated marking engine 152, 162, 172 and to deliver the sheet back to the upper or forward paper paths 196, 197 of the associated processing unit.

As further illustrated in FIG. 3, the document processing system 102 is operative to execute print jobs 118 delivered to the controller 122 from an external source, such as one or more computers 114, 116 connected to the system 102 via one or more networks 124 and associated cabling 120, or from wireless sources, or alternatively print jobs may be created by the system 102 based on documents scanned at an input scanner 136. The print job execution may include printing selected text, line graphics, images, machine ink character recognition (MICR) notation, etc., on the front and/or back sides or pages of one or more sheets of paper or other printable media. In this regard, some sheets may be left completely blank in accordance with a particular print job 118, and some sheets may have mixed color and black-and-white printing. Execution of the print job 118, moreover, may include collating the sheets in a certain order, along with specified folding, stapling, punching holes into, or otherwise physically manipulating or binding the sheets at the finisher 184. Print jobs 118 can also be provided to the controller 122 of the system 102 via an integral optical disk reader (not illustrated), and/or from a dedicated computer that is connected only to the printing system 102. In certain embodiments the system 102 may be a stand-alone printer or a cluster of networked or otherwise logically interconnected printers, with each printer having its own associated print media source and finishing components including a plurality of final media destinations, print consumable supply systems and graphical user interface. Moreover, the user interface 110 may be integral with the system 102 and/or may be implemented on one or more external devices, such as printer management application software running on one or more networked computers 114, 116, etc.

Referring now to FIGS. 4-7, FIG. 4 illustrates an exemplary method 200 in accordance with various aspects of the disclosure, which can be implemented in the exemplary systems 2, 102 of FIGS. 1-3 above or in other document processing systems. While the method 200 is illustrated and described below in the form of a series of acts or events, it will be appreciated that the various methods of the disclosure are not limited by the illustrated ordering of such acts or events. In this regard, except as specifically provided hereinafter, some acts or events may occur in different order and/or concurrently with other acts or events apart from those illustrated and described herein in accordance with the disclosure. It is further noted that not all illustrated steps may be required to implement a process or method in accordance with the present disclosure, and one or more such acts may be combined. The illustrated methods and other methods of the disclosure may be implemented in hardware, software, or combinations thereof, in order to provide the user-configurable refill level notification aspects illustrated and described herein.

Figure 4:
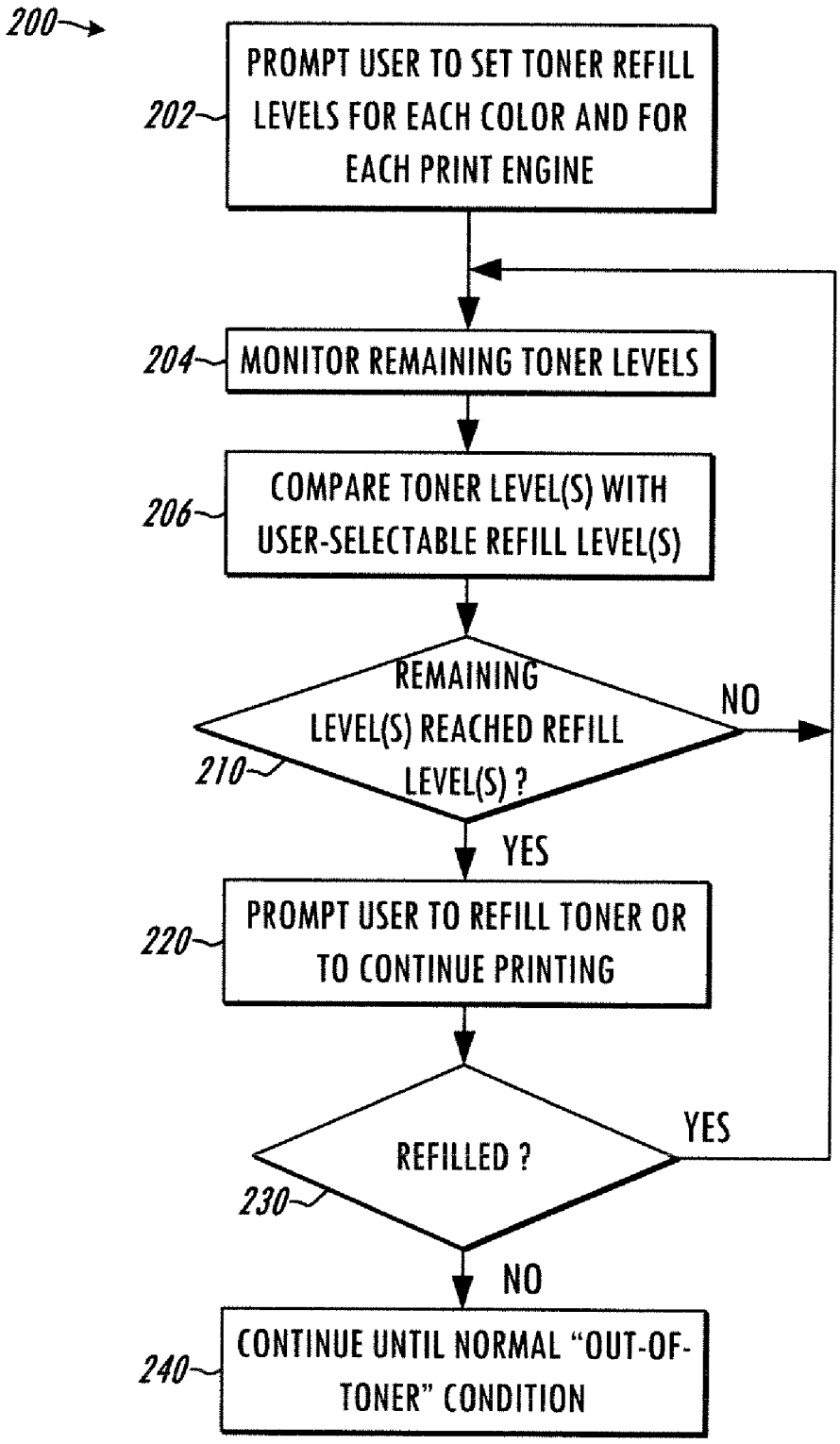
FIG. 4 is a flow diagram illustrating an exemplary method for notifying a user of the amount of remaining print consumable in a document processing system according the various aspects of the disclosure.

The method 200 begins at 202 in FIG. 4 with the interface 10, 110 prompting the user to set toner consumable refill levels for each color and each print engine. FIG. 5 illustrates an exemplary displayed screen 300 in the interface 10, 110 that prompts a user to set consumable toner refill levels for a dual print engine multi-color printing system for automatic user notification. In the illustrated example, each print engine has five toner dispenser bottles for each color C, M, Y, and K (e.g., as shown in FIG. 2 above), where the prompt screen 300 indicates each dispenser with a bottle indicator 301, where the individual bottle indicators 301 may be rendered in a color showing to the toner color to which they correspond, if the interface 10, 110 is color-capable. The interface 10, 110 allows the user to select one bottle indicator of each color C, M, Y, and K as the level at which the user desires to receive an automatic refill notification, whereupon the selected bottle indicator in the screen 300 of FIG. 5 is changed to a refill level indicia 302. In this example, the refill threshold is represented as an enlarged bottle, although any suitable indicia can be used to graphically indicate the user's selected refill level. The user may be provided with selection tools by which fractional bottle levels can be selected, such as when the third bottle is ¼ empty, ½ full, etc., based on the granularity of the sensing capabilities of the consumable supply system, and which may be particularly advantageous for single dispensers for a given consumable (e.g., paper trays, ink supplies, etc.). The user prompting and selection, moreover, may be of any suitable form, such as touch screen activation wherein the user can simply touch the bottle at which the level is to be set, or the selection may be made by mouse, keypad, interface buttons or pointing devices, menu selections, etc., wherein all such variant implementations are contemplated as falling within the scope of the present disclosure.

As shown in FIG. 5, the user in this case has selected to receive an automatic refill notification from the interface 10, 110 when the fourth bottle of the C, M, and/or Y color toner is empty (e.g., notification "After Bottle 4" on the screen 300), and has further elected to be notified to refill the black (K) toner after the third bottle is emptied for the first print engine 6*a* (FIG. 2). The illustrated screen 300 additionally provides selectable drop-down indicia 310 allowing the user to set desired refill notification levels in similar fashion for the second print engine 6*b* ("Print Engine 2"). The user is further provided with selectable "Undo", "Cancel", and "OK" controls 320 on the exemplary toner status settings screen in FIG. 5, although not a strict requirement of the disclosure.

Returning to the method 200 of FIG. 4, the remaining toner levels are monitored at 204 for all colors C, M, Y, and K and both print engines 6*a* and 6*b*, with the interface 10, 110 or controller 8 comparing these at 206 to the user-defined refill levels set at 202. A determination is made at 210 as to whether any of the remaining toner levels have reached the refill levels. If not (NO at 210), the method 200 returns to continue monitoring the levels and comparing them to the refill values at 204 and 206 as described above. If one or more of the toner levels has reached the user-selected refill levels (YES at 210), the user is notified at 220 by the user interface 10, 110 prompting the user to either refill the designated toner or to bypass the notification to continue printing.

Referring also to FIGS. 6 and 7, FIG. 6 shows the user interface 10, 110 in the systems of FIGS. 1-3 rendering a notification screen 350 to the user when Black toner (K) has reached the user-selected refill level (e.g., after the third bottle dispenser has been emptied in the illustrated example). In this exemplary display 350, only the toner color that has reached the refill level is shown, where the display 350 in this implementation provides the multiple bottle depiction and bottle indicators 301 and 302 similar to that of the settings screen 300 in FIG. 5, although the particular form and content of the illustrated depictions are not strict requirements of the present disclosure. In the example of FIG. 6, the user selected level is again indicated by the enlarged bottle indicia 302 with the other bottles being indicated by the smaller indicia 301. In other possible implementations, the emptied bottles may be alternately indicated by empty indicia to enhance the user's visual depiction of the current toner level situation in the system 2, 102, although not a requirement of the disclosure. The notification display 350 further prompts the user to refill the toner supply system or to continue system use without refilling, in this case by providing instructional text stating "Add Black Toner OR: Select "Continue" to resume printing." The user in this case is also presented with a selectable "Continue" button or other means for bypassing the option to refill the toner at this time. In the exemplary systems 2, 102, the printing continues while the notification screen 350 is presented on the interface 10, 110, although not a strict requirement of the disclosure. In addition, the system 2, 102 may be operable while the designated toner is refilled, such as in the exemplary multiple bottle supply system example of FIG. 2 above, in which case the user is allowed to refill the toner while the document processing system 2, 102 continues to operate.

FIG. 7 shows an exemplary notification screen 360 on the interface 10, 110 for another situation in which the other three toner colors concurrently reach the user-selected refill levels (e.g., as the fourth bottles are emptied in the example described above). In this case, the screen 360 notifies the user that the refill levels have been reached for the indicated colors C, M, and Y, and prompts the user to "Add Cyan, Magenta, and Yellow Toner OR: Select "Continue" to resume printing."

Returning again to FIG. 4, a determination is made at 230 for any designated toner colors as to whether the toner supply had been refilled. If so (YES at 230), the process returns to monitoring as described above. If, however, the user has chosen to continue without refilling the designated toner color or colors (NO at 230), the operation continues at 240 until the normal "out-of-toner" level is reached, at which time the user interface 10, 110 displays the traditional indication that toner must be added to continue printing, where the system 2, 102 generally stops upon reaching this depleted level.

The above examples are merely illustrative of several possible embodiments of the present disclosure, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, software, or combinations thereof, which performs the specified function of the described component (i.e., that is functionally equivalent), even though not structurally equivalent to the disclosed structure which performs the function in the illustrated implementations of the disclosure. In addition, although a particular feature of the disclosure may have been disclosed with respect to only one of several embodiments, such feature may be combined with one or more other features of the other implementations as may be desired and advantageous for any given or particular application. Also, to the extent that the terms "including", "includes", "having", "has", "with", or variants thereof are used in the detailed description and/or in the claims, such terms are intended to be inclusive in a manner similar to the term "comprising". It will be appreciated that various of the above-disclosed and other features and functions, or alternatives thereof, may be desirably combined into many other different systems or applications, and further that various presently unforeseen or unanticipated alternatives, modifications, variations or improvements therein may be subsequently made by those skilled in the art which are also intended to be encompassed by the following claims.

The invention claimed is:

1. A document processing system, comprising:

a print engine operative to print images on a printable media;

a print consumable supply system operative to supply print consumable from one or more print consumable dispensers to the print engine;

a controller operatively coupled with the print engine and the print consumable supply system to determine an amount of remaining print consumable; and a user interface operatively coupled with the controller to provide a notification when the amount of remaining print consumable reaches a user-selectable refill level, wherein the user interface is operative, when the refill level has been reached, to render a display screen indicating that the refill level has been reached, and to prompt the user to either refill the print consumable or to continue use of the document processing system without refilling.

2. The system of claim 1, wherein the user interface is operative to prompt a user to set the user-selectable refill level.

3. The system of claim 1, wherein the user interface is further operative, if the user continues use of the document processing system without refilling, to provide a subsequent notification when the amount of remaining print consumable reaches a fixed value.

4. The system of claim 1:

wherein the print engine uses print consumable of a first color;

wherein the print consumable supply system includes a plurality of dispensers to supply print consumable associated with the first color, the plurality of dispensers comprising:

a first dispenser to provide print consumable associated with the first color to the print engine, and a second dispenser adjacent to the first dispenser, the second dispenser storing print consumable associated with the first color and being operative to provide print consumable associated with the first color to the first dispenser as the first dispenser provides print consumable to the print engine;

wherein the controller is operative to determine an amount of remaining print consumable in the first and second dispensers associated with the first color; and wherein the user interface is operative to allow the user to set a refill level for the print consumable associated with the first color with respect to a number of empty dispensers associated with the first color and to provide a notification when the refill level associated with the first color has been reached.

5. The system of claim 4, wherein the user interface is further operative, if the user continues use of the document processing system without refilling, to provide a subsequent notification when the amount of remaining print consumable reaches a fixed value.

6. The document processing system of claim 1, wherein the print engine uses print consumable of a plurality of colors, wherein the print consumable supply system includes dispensers to supply print consumable associated with each of at least two of the plurality of colors, wherein the user interface is operative to allow the user to set individual refill levels for the print consumable of each of the at least two of the plurality of colors and to provide a notification when either refill level has been reached, and wherein the notification indicates to the user which refill level has been reached.

7. The system of claim 6, wherein the user interface is operative, when either of the refill levels have been reached, to render a display screen indicating which refill level has been reached, and to prompt the user to either refill the indicated print consumable or to continue use of the document processing system without refilling.

8. The system of claim 7, wherein the user interface is further operative, if the user continues use of the document processing system without refilling, to provide a subsequent notification when the amount of remaining print consumable reaches a fixed value.

9. The document processing system of claim 1, wherein the user interface comprises a graphic display.

10. The document processing system of claim 1, wherein the print consumable is toner.

11. The document processing system of claim 1, wherein the print consumable is replenisher.

12. The document processing system of claim 1, wherein the user interface is integral with the system.

13. The document processing system of claim 1, wherein the user interface is operative to provide a notification to prompt the user to refill the one or more print consumable dispensers when the amount of remaining print consumable reaches the user-selectable refill level, and where the user-selectable refill level indicates a consumable level at which the user desires to be prompted to refill the one or more print consumable dispensers.

14. A method of notifying a user of the amount of remaining print consumable in a document processing system, the method comprising:

automatically determining an amount of remaining print consumable in one or more print consumable dispensers in a print consumable supply system that supplies print consumable to a print engine of the system;

comparing the amount of remaining print consumable to a user-selectable refill level;

selectively providing a notification to a user when the amount of remaining print consumable reaches the user-selectable refill level using a user interface operatively associated with the document processing system; and prompting the user to either refill the print consumable or to continue use of the document processing system without refilling when the user-selectable refill level has been reached.

15. The method of claim 14, further comprising prompting the user to set the user-selectable refill level via the user interface.

16. The method of claim 15, wherein the notification is provided using a graphic display of the user interface.

17. The method of claim 14, further comprising providing a subsequent notification when the amount of remaining print consumable reaches a fixed value below the user-selectable refill level if the user continues use of the document processing system without refilling.

18. The method of claim 14, further comprising allowing the user to refill the print consumable while the document processing system continues to operate.

19. The method of claim 14, wherein the user-selectable refill level indicates a consumable level at which the user desires to be prompted to refill the one or more print consumable dispensers; and wherein providing the notification prompts the user to refill the one or more print consumable dispensers.

* * * * *